US007423618B2

(12) United States Patent
Song

(10) Patent No.: US 7,423,618 B2
(45) Date of Patent: Sep. 9, 2008

(54) DITHERING METHOD AND APPARATUS FOR LIQUID CRYSTAL DISPLAY PANEL

(75) Inventor: Byung Chan Song, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 749 days.

(21) Appl. No.: 11/022,635

(22) Filed: Dec. 28, 2004

(65) Prior Publication Data

US 2005/0219176 A1 Oct. 6, 2005

(30) Foreign Application Priority Data

Mar. 31, 2004 (KR) ..... 10-2004-0021984

(51) Int. Cl.
*G09G 3/36* (2006.01)

(52) U.S. Cl. ..... 345/87; 345/88; 345/89

(58) Field of Classification Search ..... 345/60, 345/63, 87–90, 99–100, 204, 545, 547, 596, 345/599; 358/1.2, 2.1, 3.13, 3.22; 382/236–237, 382/266–275

See application file for complete search history.

(56) References Cited

U.S. PATENT DOCUMENTS 6,731,407 B1 * 5/2004 Hayama ..... 358/3.2
6,965,358 B1 * 11/2005 Kasahara et al. ..... 345/63
2005/0219176 A1 * 10/2005 Song ..... 345/87

* cited by examiner

*Primary Examiner*—Richard Hjerpe
*Assistant Examiner*—Mansour M Said
(74) *Attorney, Agent, or Firm*—McKenna, Long & Aldridge LLP

(57) ABSTRACT

A dithering method and apparatus for a liquid crystal display is provided, wherein dithering with frame rate control and dithering without frame rate control can be selectively performed in accordance with the pattern characteristics of the input data to prevent the picture quality deterioration which can result from FRC dithering video data representing specific patterns. The pattern characteristic of the input video data is determined by a phase difference comparison between adjacent video data. A first dithering process is performed on the video data if pattern characteristic of the video data is determined to be a specific pattern, and a second dithering process utilizing a frame rate control is performed on the video data if the pattern characteristic is determined to be a general pattern.

4 Claims, 3 Drawing Sheets

DITHERING METHOD AND APPARATUS FOR LIQUID CRYSTAL DISPLAY PANEL

This application claims the benefit of Korean Patent Application No. P2004-21984 filed in Korea on Mar. 31, 2004, which is hereby incorporated by reference in its entirety.

BACKGROUND OF THE INVENTION

1. Field of the Invention

This invention relates to a liquid crystal display, and more particularly to a method and apparatus for adaptively reducing picture quality deterioration caused by a dithering in a liquid crystal display panel.

2. Description of the Related Art

Generally, in a liquid crystal display (LCD) a picture is displayed by controlling the light transmittance of the liquid crystal having a dielectric anisotropy. To this end, the LCD includes a liquid crystal display panel having a pixel matrix, and a driver for driving the liquid crystal display panel.

Specifically, as shown in FIG. 1, the LCD includes a liquid crystal display panel 12 having a pixel matrix 10, a gate driver 12 for driving gate lines GL1 to GLm of the liquid crystal display panel, a data driver 14 for driving data lines DL1 to DLn of the liquid crystal display panel, and a timing controller 16 for controlling driving timings of the gate driver 12 and the data driver 14.

The liquid crystal display panel includes a pixel matrix 10 consisting of pixels formed for each area defined by intersections between the gate lines GL and the data lines DL. Each of the pixels includes a liquid crystal cell LC for controlling a light transmission amount in accordance with a pixel signal, and a thin film transistor TFT for driving the liquid crystal cell LC.

The thin film transistor TFT is turned on when a gate-on voltage (VGH) from the gate line GL is supplied, to thereby supply a pixel signal from the data line DL to the liquid crystal cell LC. Further, the thin film transistor TFT is turned off when a gate-off low voltage (VGL) from the gate line GL is supplied, to thereby keep a pixel signal charged in the liquid crystal cell LC.

The liquid crystal cell LC can be expressed equivalently as a capacitor Clc. The equivalent capacitor consists of a common electrode opposed to a pixel electrode connected to the thin film transistor TFT, and a liquid crystal between the electrodes. Furthermore, the liquid crystal cell LC includes a storage capacitor (not shown) so as to stably keep the charged pixel signal until the next pixel signal is charged. Gray scale levels are achieved by controlling light transmittance of the liquid crystal cell. The light transmittance is controlled by changing the alignment state of the liquid crystal having a dielectric anisotropy in accordance with the pixel signal charged through the thin film transistor TFT, as discussed below.

The gate driver 12 shifts a gate start pulse (GSP) from the timing controller 16 in response to a gate shift clock (GSC) (not shown) to thereby sequentially apply a scanning pulse having the gate-on voltage (VGH) from a power supply (not shown) to the gate lines GL1 to GLm. The gate driver 12 applies a gate-off voltage (VGL) from the power supply to the gate lines GL to GLm in the remaining interval during which a scanning pulse having the gate-on voltage (VGH) is not applied. Such a gate driver 12 controls the width of the scanning pulse in response to a gate output enable signal (GOE) from the timing controller 16.

The data driver 14 shifts a source start pulse (SSP) from the timing controller 16 in response to a source shift clock (SSC) to generate a sampling signal. Further, the data driver 14 latches pixel data (RGB) inputted in accordance with the source shift clock (SSC) in response to the sampling signal and thereafter applies the latched sampling signal line by line in response to a source output enable signal (SOE). Then, the data driver 14 converts the pixel data (RGB) applied line by line into analog pixel signals using gamma voltages from a gamma voltage part (not shown) to apply them to the data lines DL to DLm. The data driver 14 then determines a polarity of the pixel signal in response to a polarity control signal (POL) from the timing controller 16 when the pixel data are converted into the pixel signals. The data driver 14 determines the time interval at which the pixel signals are applied to the data lines DL in response to the source output enable signal (SOE).

The timing controller 16 generates signals, for example, GSP, GSC and GOE, to control the gate driver 12 and signals, for example, SSP, SSC, SOE and POL, to control the data driver 14. The timing controller 18 generates the control signals using a data enable signal DE which indicates an effective data interval inputted from the exterior, a horizontal synchronizing signal Hsync, a vertical synchronizing signal Vsync and a dot clock DCLK which determines the transmission timing of the pixel data RGB.

A liquid crystal display (LCD) having the above-mentioned configuration employs a dithering method using a frame rate control algorithm (FRC), hereinafter referred to as "FRC dithering", in order to increase the gray level. The FRC dithering method divides a pixel in a picture field into a certain size of dithering blocks to control pixel brightness within the blocks and to differentiate the pixel brightness within the block for each frame. Accordingly, the FRC dithering method allows a larger number of gray levels to be displayed than the predetermined number of gray levels displayable without dithering.

When the FRC dithering method is used for an LCD in which one pixel can display 18-bit colors by a combination of R, G, and B data, it can obtain an effect similar to a case in which 24-bit colors arc displayed by a combination of the R, G, and B data, each of which has 8 bits. The FRC dithering function is generally built in a scaler IC of a computer or a timing controller of the LCD. Thus, the scaler IC makes a FRC dithering process of an input data to transmit it to the LCD capable of displaying 18-bit colors, or to transmit 24-bit R, G, and B data to the LCD in which the FRC dithering function is built.

However, there is a disadvantage with the FRC dithering process when it is utilized in an LCD driven by a vertical 2-dot inversion system. More specifically, the FRC dithering process is applied to specific patterns, for example, a dot pattern or a vertical stripe pattern, the FRC dithering process deteriorates the picture quality by introducing a flicker, noise, and/or dark bar into the displayed picture.

SUMMARY OF THE INVENTION

Accordingly, the invention is directed to a dithering method and apparatus for a liquid crystal display panel that substantially obviates one or more of the problems due to limitations and disadvantages of the related art.

Accordingly, it is an advantage of the invention to provide a method and apparatus for selectively performing dithering and FRC in a liquid crystal display in accordance with input data to prevent deterioration of picture quality in a specific pattern.

In order to achieve these and other advantages of the invention, a method for selectively performing dithering in a liquid crystal display according to one aspect of the invention includes the steps of: determining a pattern characteristic of input video data using a phase difference comparison; performing a first dithering process on the video data when it is determined to be a specific pattern at said determining step; and performing a second dithering process utilizing a frame rate control on the video data when it is determined to be a general pattern.

In the method, the step of determining the pattern characteristic of the video data includes detecting a phase difference between the video data and adjacent video data; comparing a sum of 1's complements of the detected phase difference with a predetermined threshold value; and determining the video data to be said specific pattern when said phase difference sum is smaller than said threshold value while determining the video data to be a general pattern when it is larger than or equal to said threshold value.

An apparatus for performing selective dithering in a liquid crystal display according to another aspect of the invention includes: a scaler configured to perform a first dithering process on input video data when the input video data is determined to have a specific pattern by a phase difference comparison while outputting the video data with no dithering when the input video data is determined to have a general pattern; and a timing controller configured to perform a second dithering process utilizing a frame rate control of said general pattern video data from the scaler.

In the apparatus, the scaler is configured to detect a phase difference between said video data, and adjacent video data; compare a sum of 1's complements of the phase difference with a predetermined threshold value; and determine said video data to be said specific pattern when said phase difference sum is smaller than said threshold value while determining said video data to be said general pattern when it is larger than or equal to said threshold value.

The scaler adds a dummy bit to said video data having undergone a first dithering process such that it has the same bit number as said general pattern to thereby apply it to the timing controller.

Herein, the timing controller is configured to perform a second dithering process on said video data determined to have said specific pattern to eliminate said added dummy bit, thereby outputting it.

BRIEF DESCRIPTION OF THE DRAWINGS

The accompanying drawins, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to embodiments of the invention, examples of which are illustrated in the accompanying drawings.

Hereinafter, the embodiments of the invention will be described in detail with reference to FIGS. 2 and 3.

Figure 1:
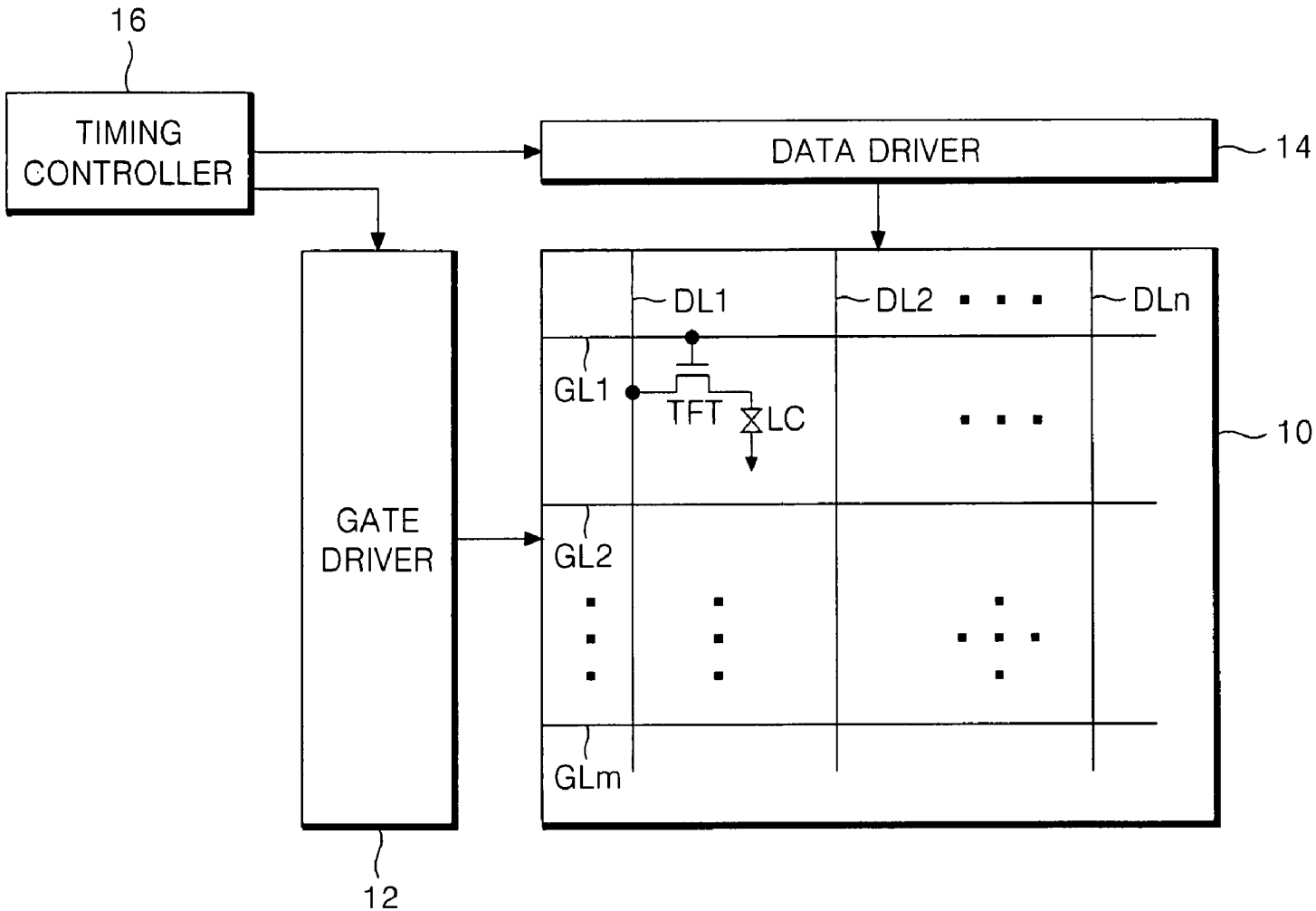
FIG. 1 RELATED ART
FIG. 1 is a schematic block diagram showing a configuration of a conventional liquid, crystal display.
Figure 2:
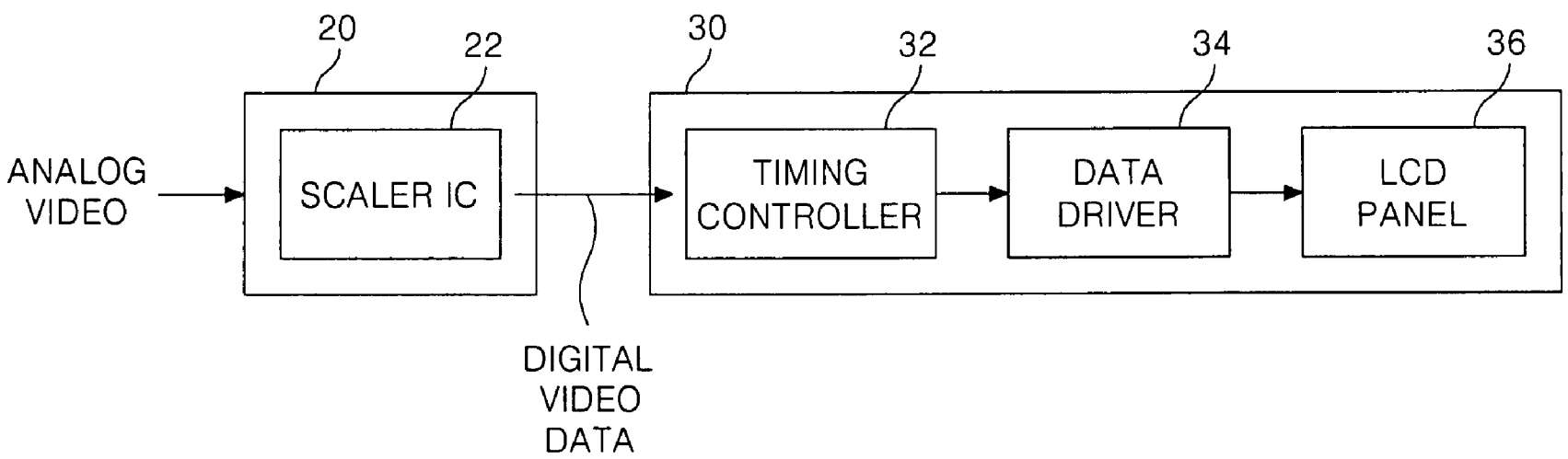
FIG. 2 is a block diagram showing a configuration of a liquid crystal display according to an embodiment of the invention.
Figure 3:
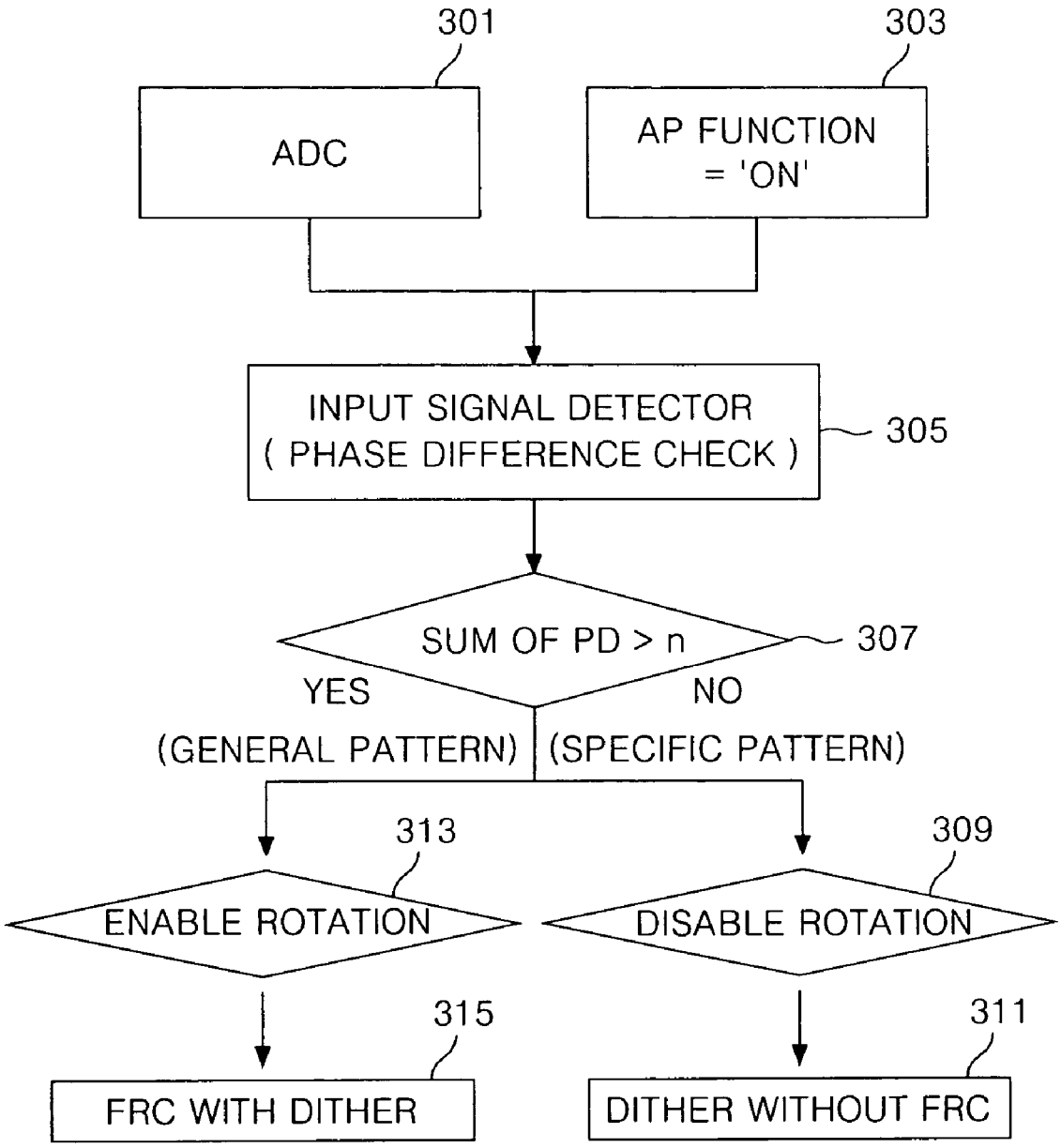
FIG. 3 is a flow chart representing a method according to an embodiment of the invention.

FIG. 2 is a block diagram showing a configuration of a liquid crystal display according to an embodiment of the invention, and FIG. 3 is a flow chart representing a selective dithering method according to an embodiment of the invention.

The apparatus shown in FIG. 2 includes a scaler IC 22 built in a computer 20, and a timing controller 32, a data driver 34 and a liquid crystal display panel 36 that are built in a liquid crystal display module 30.

Referring to FIG. 2, the scaler IC 22 converts analog video signals into digital video data. In addition, the scaler IC 22 determines whether the digital video data represents a specific pattern that does not require FRC dithering or a general pattern. More specifically, the scaler IC 22 detects the phase difference (PD) between adjacent video data to determine if the data represents a specific pattern. If the sum of the 1's complement of the detected phase difference is smaller than a threshold value n, the video data is determined to represent a specific pattern. Otherwise, the data is determined to represent a general pattern when it is larger than or equal to the threshold value n. The threshold value n is selected based on the fact that the sum of the phase difference decreases when the video data represents a dot pattern, a single vertical stripe pattern, or another specific pattern. The scaler IC 22 also detects a clock and a phase when the phase difference has a maximum value for the purpose of detecting the phase difference PD, thereby turning on an auto-phase (AP) function acting as a focusing function.

A selective dithering method according to an embodiment of the invention is shown in FIG. 3. At step 305, the scaler IC detects the phase difference between adjacent video data. The phase difference is compared to a predetermined threshold value at step 307. If the phase difference is greater than the threshold value n (YES path out of step 307), then rotation is enabled at step 313 and FRC dithering is performed in the timing controller 32 at step 315. Otherwise (NO path out of step 307), rotation is disabled at step 309 and the scaler IC 22 performs a simple dithering process with no frame rate control at step 311.

The simple dithering process with no FRC used in step can be, for example, a dithering process using a dithering pattern unchanged for each frame. More specifically, the dithering circuitry of scaler IC 22 separates the 8-bit video data input into the most significant bits and the 2 least significant bits, and then compares the 2 least significant bits with a pre-stored dithering pattern to calculate a one bit dithering value. The scaler IC 22 then adds the calculated dithering value to the 6 most significant bits using a carry signal to output 6-bit video data. In addition, the dithering circuitry adds a dummy bits '00' as the least significant bits to the dithered 6-bit video data, thereby supplying an 8-bit video data to the timing controller 32 of the liquid crystal display module 30. On the other hand, when the video data is determined to represent a general pattern (YES path out of step 307), the scaler IC 22 supplies 8-bit video data that does not go through the dithering part to the liquid crystal display module 30.

The FRC dithering circuitry built in the timing controller 32 preforms a FRC dithering process on the 8-bit video data inputted from the scaler IC 22 to convert it to 6-bit data, thereby applying the converted data to the data driver 34. More specifically, the FRC dithering circuitry separates the 8-bit video data inputted from the scaler IC 22 into the 6 most significant bits and the 2 least significant bits, and then compares the 2 least significant bits with a pre-stored dummy pattern to calculate a one bit dithering value. Unlike the dithering process performed by the scaler IC 22, the FRC dithering circuitry of the timing controller toggles the pre-stored dummy pattern every fourth frame and compares it with the 2 least significant bits of the input video data to calculate a one bit dithering value bit. The one bit dithering value is then added to the 6 most significant bits using a carry signal to output 6-bit video data.

As a result, the video data having a specific pattern to which a dummy bit '00' is added via the dithering part of the scaler IC 22 is outputted as 6-bit data removed with the dummy bit from the FRC dithering part. Further, the video data having a general pattern that does not go through the dithering part of the scaler IC 22 is outputted as 6-bit data experiencing the FRC dithering process.

With the aid of the scaler IC 22 and the timing controller 32, the specific pattern undergoes a simple dithering process with no FRC while the general pattern undergoes the FRC dithering process, before applying them to the data driver 34.

The data driver 34 converts the 6-bit video data inputted from the timing controller 32 into analog video signals and applies them to liquid crystal display panel 36.

Accordingly, the liquid crystal display panel 36 can implement gray levels similar to 8-bit video signals while using 6-bit video signals.

As described above, according to the invention, the dithering with FRC and dithering with no FRC is selectively performed depending upon a property of the video data, in order to prevent deterioration in picture quality which can be caused by the FRC dithering process of specific patterns.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A dithering method for a liquid crystal display, comprising:

determining a pattern characteristic of input video data using a phase difference comparison;

performing a first dithering process on the video data if the pattern characteristic is determined to be a specific pattern at said determining step; and performing a second dithering process utilizing frame rate control on the video data if the pattern characteristic is determined to be a general pattern, wherein the step of determining the pattern characteristic of the video data comprises:

detecting a phase difference between adjacent video data;

comparing a sum of the 1's complement of the detected phase difference with a predetermined threshold value; and determining the pattern characteristic of the video data to be said specific pattern if the sum is smaller than said threshold value while determining the pattern characteristic of the video data to be said general pattern when the sum is larger than or equal to said threshold value.

2. A dithering apparatus for a liquid crystal display, comprising:

a scaler configured to perform a first dithering process on input video data if a pattern characteristic of the input video data is determined to be a specific pattern by a phase difference comparison while outputting the video data with no dithering when the pattern characteristic of the input video data is determined to have a general pattern; and a timing controller configured to perform a second dithering process utilizing frame rate control on said general pattern video data from the scaler wherein the scaler is further configured to:

detect a phase difference between adjacent video data;

compare a sum of the 1's complement of the detected phase difference with a predetermined threshold value; and determine the pattern characteristic of the video data to be said specific pattern if the sum is smaller than said threshold value while determining said pattern characteristic of the video data to be said general pattern if the sum is larger than or equal to said threshold value.

3. The apparatus according to claim 2, wherein the scaler is further configured to:

add a dummy bit to the video data having undergone said first dithering process such that it has the same bit number as the general pattern video data; and supply the video data with the added dummy bits to the timing controller.

4. The apparatus according to claim 3, wherein the timing controller is further configured to perform a second dithering process on the video data having the added dummy bits to eliminate the added dummy bits.

* * * * *